US007263917B1

(12) United States Patent
Benysh et al.

(10) Patent No.: US 7,263,917 B1
(45) Date of Patent: Sep. 4, 2007

(54) OPEN-ENDED SPIN TOOL

(75) Inventors: Susan A. Benysh, Rochester, MN (US); Scott L. Christopherson, Rochester, MN (US); Edward C. Gillard, Mantorville, MN (US); Don A. Gilliland, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/459,670

(22) Filed: Jul. 25, 2006

(51) Int. Cl.
*B25B 17/00* (2006.01)
*B25B 7/02* (2006.01)
*B25B 13/00* (2006.01)

(52) U.S. Cl. ..... 81/57.17; 81/57.36; 81/418; 81/90.3; 81/186

(58) Field of Classification Search ..... 81/57.15, 81/57.17, 57.22, 57.34, 57.36, 418, 186, 81/90.1–90.5, 3.43, 64
See application file for complete search history.

(56) References Cited

U.S. PATENT DOCUMENTS 1,760,167 A * 5/1930 Palmer ..... 81/57.17
3,774,481 A * 11/1973 Goodman ..... 81/57.17
4,770,070 A * 9/1988 Sowers ..... 81/90.5
5,249,487 A * 10/1993 Armfield, IV ..... 81/418
6,796,385 B1 9/2004 Cobzaru et al.

* cited by examiner

*Primary Examiner*—Hadi Shaken
(74) *Attorney, Agent, or Firm*—Cantor Colburn LLP; Robert Williams

(57) ABSTRACT

An open-ended spin tool comprising a first z-shaped structure, a second z-shaped structure, the second z-shaped structure being pivotably associated with the first z-shaped structure, a first gripping portion cavity, a first actuatable roller and a second actuatable roller, a rubber belt disposed parametrically around the first actuatable roller and the second actuatable roller, wherein the rubber belt is deformable to at least partially conform to a rotatable element, a motor to actuate rotation of the first actuatable roller and the second actuatable roller, at least one trigger roller, and an electric association between the at least one trigger roller and the motor, wherein depression of the at least one trigger roller triggers the motor to actuate rotation of the first actuatable roller and the second actuatable roller.

4 Claims, 3 Drawing Sheets

OPEN-ENDED SPIN TOOL

BACKGROUND OF THE INVENTION

1. Field of the Invention

The disclosure relates generally to an open-ended spin tool, and more particularly to an open-ended spin tool with actuatable components.

2. Description of Background

Nuts and bolts, particularly nuts and bolts that must be screwed onto or off of a threaded instrument in a confined space, can be difficult to manipulate by hand or with standard pliers/wrenches, and the process of manipulation can be time consuming. This is because the confined spaces in which these nuts and bolts reside may not offer enough area to rotate or conveniently rotate the pliers/wrench used to screw/unscrew the nut or bolt. Thus, a tool that will allow a user to more easily and efficiently screw or unscrew a nut or a bolt onto or off of a threaded instrument is desired.

SUMMARY OF THE INVENTION

An open-ended spin tool comprising a first z-shaped structure including a first handle portion swivelably associated with a first gripping portion, a second z-shaped structure including a second handle portion swivelably associated with a second gripping portion, the second z-shaped structure being pivotably associated with the first z-shaped structure, a first gripping portion cavity defined by the first gripping portion, a first actuatable roller and a second actuatable roller at least partially disposed in the first gripping portion cavity, each of the first actuatable roller and the second actuatable roller being rotatably associated with the first gripping portion at an axis of each of the first actuatable roller and the second actuatable roller, a rubber belt disposed parametrically around the first actuatable roller and the second actuatable roller, the rubber belt being moveable in a direction of rotation of the first actuatable roller and the second actuatable roller, wherein the rubber belt is deformable between the first actuatable roller and the second actuatable roller to at least partially conform to a rotatable element, a motor to actuate rotation of the first actuatable roller and the second actuatable roller, the motor being disposable in the first gripping portion cavity, at least one trigger roller at least partially disposed in a second gripping portion cavity defined by the second gripping portion, the at least one trigger roller being depressible within the second gripping portion cavity upon contact of the rotatable element by the rubber belt and the at least one trigger roller, and an electric association between the at least one trigger roller and the motor, wherein depression of the at least one trigger roller triggers the motor to actuate rotation of the first actuatable roller and the second actuatable roller, the depression of the at least one trigger roller being signaled to the motor via the electric association.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION OF THE INVENTION

Figure 1:
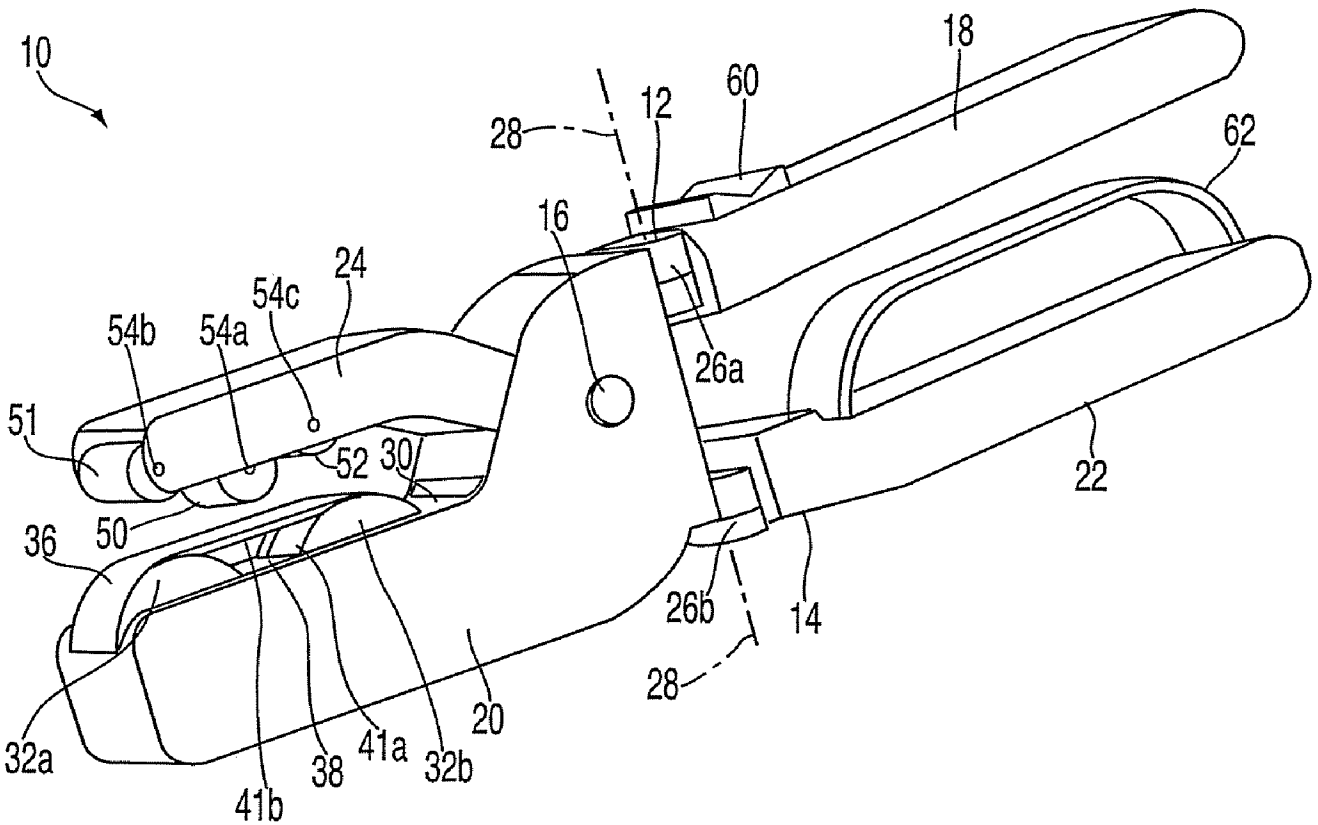
FIG. 1 is a side perspective view of an open-ended spin tool.
Figure 2:
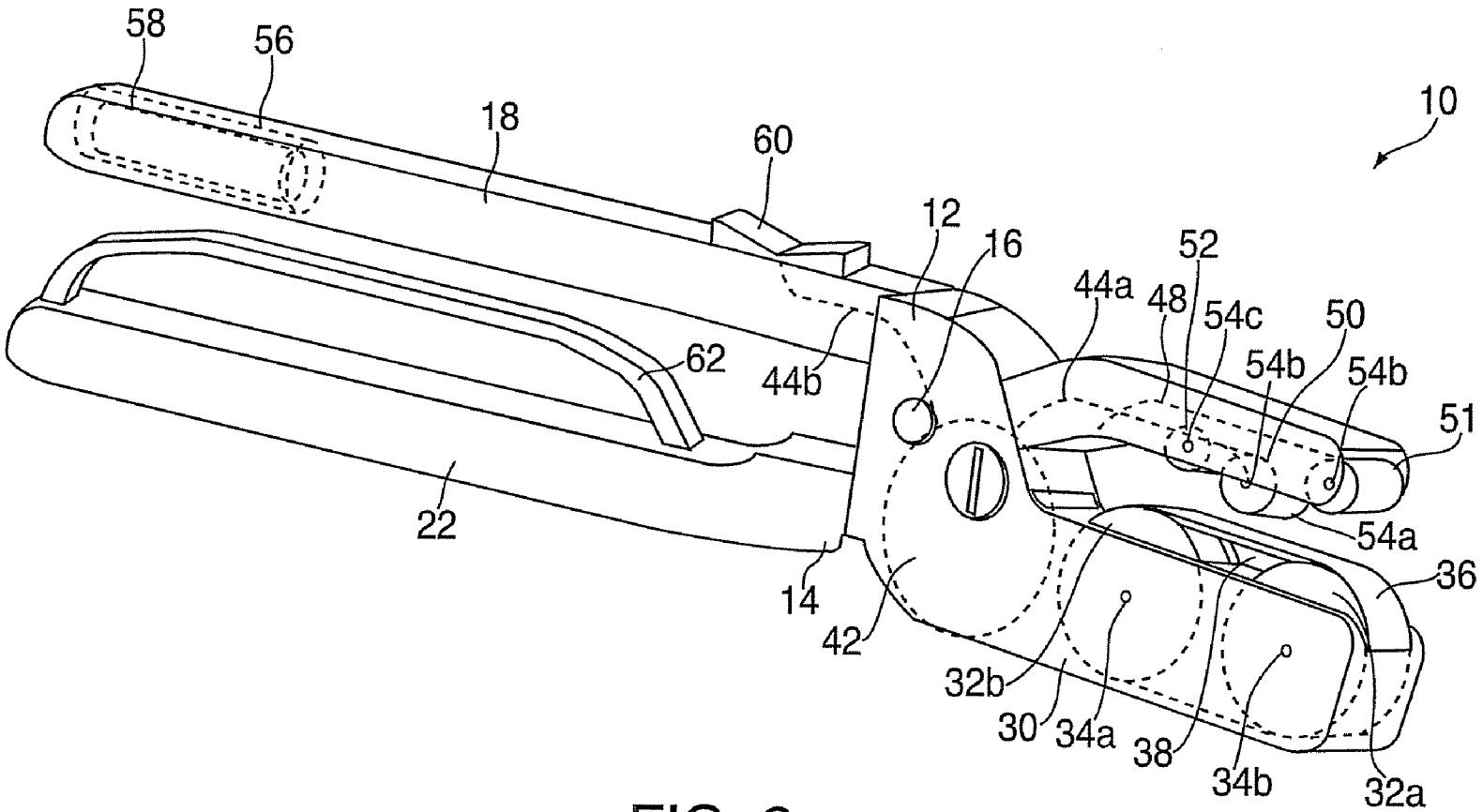
FIG. 2 is a schematic side perspective view of the open-ended spin tool, further illustrating some internal components in broken lines.
Figure 3:
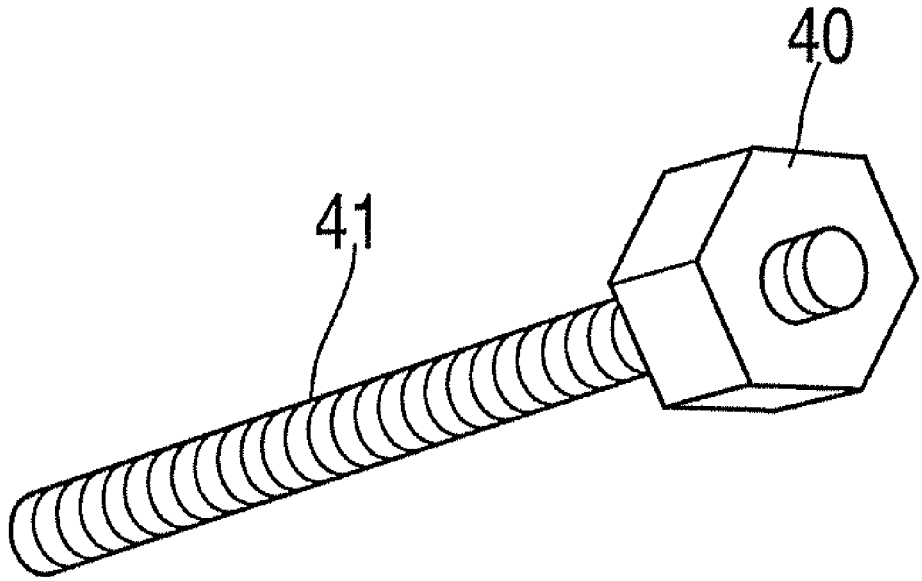
FIG. 3 is a side perspective view of a rotatable element and a screw.

Referring to FIGS. 1, 2, and 3 an open-ended spin tool 10 is illustrated. The tool 10 includes a first z-shaped structure 12 pivotably associated with a second z-shaped structure 14 at an articulated joint 16. The first structure 12 includes a first handle portion 18 and a first gripping portion 20. The second structure 14 includes a second handle portion 22 and a second gripping portion 24. The structures 12 and 14 are configured similarly to a pair of pliers, in that moving of the first handle portion 18 towards the second handle portion 22 simultaneously moves the first gripping portion 20 towards the second gripping portion 24. Likewise, moving the first handle portion 18 and second handle portion 22 away from each other, simultaneously moves the first gripping portion 20 away from the second gripping portion 24. In addition, the first gripping portion 20 is swivelably associated with the first handle portion 18 via hinge 26*a*, and the second gripping portion 20 is swivelably associated with the second handle portion 18 via hinge 26*b*. The hinges 26*a-b* allow the first gripping portion 20 and second gripping portion 24 to swivel about a hinged axis 28 created by the hinges 26*a-b*, with swiveling occurring independently of movement of the handle portions 18 and 22.

Each portion of the tool 10 (i.e. the handle portions 18 and 22, and the gripping portion 20 and 24) and their components will now be discussed in greater detail. Referring first to the first gripping portion 20, there is defined a first gripping portion cavity 30. The first gripping portion cavity 30 at least partially contains a first actuatable roller 32*a* and a second actuatable roller 32*b*. Each actuatable roller 32*a-b* is rotatably associated with the first gripping portion 20 at an axis of each, illustrated as axis 34*a* and 34*b*, with the rotatable association occurring within the first gripping portion cavity 30. Disposed parametrically around the rollers 32*a-b* is a rubber belt 36. The rubber comprising the rubber belt 36 is compliant enough to deform into a region 38 between the rollers 32*a-b* when depressed by a rotatable element 40 such as a nut or bolt disposed upon (or to be disposed upon) a screw 41(see FIG. 3). Rubber belt 36 depression by the rotatable element 40 will be further discussed later in the disclosure.

It should be appreciated that the rubber belt 36 is disposed about the rollers 32*a-b* in a manner that allows the belt 36 to move in a direction of rotation of the rotatable rollers 32*a-b*. Movement of the belt 36 along with the rollers 32*a-b* may be accomplished via any means desired, including a toothed belt disposed on spurred rollers. Spurs and teeth, disposed on the rollers 32*a-b* and belt 36 respectively, allows the rotating rollers 32*a-b* to grip and release the belt 36 as it is conveyed in the direction of rotation.

Also disposed in the first gripping cavity 30 is a motor 42, such as a geared motor. The motor 42 actuates rotation of the rollers 32*a-b* and the resultant movement of the belt 36, and is electronically associated with at least one trigger roller 50-52 and a position switch 60 (via electronic association 44*a-b*), which will each be discussed further along in the disclosure.

Referring now the second gripping portion 24, there is defined a second gripping portion cavity 48. At least partially contained in the second gripping portion cavity 48 is at least one trigger roller 50-52 (introduced briefly above), wherein the trigger roller 50 is depressible into the second gripping portion cavity 48. The trigger roller 50 is also electronically connected with the motor 42, as was briefly mentioned above. Each trigger roller 50-52 is rotatable about an axis 54*a-c*.

Referring now to the handle portions 18 and 22, there may be defined at least one battery cavity 56*a-b*. Each battery cavity 56 may be configured to house at least one battery 58*a-b*, which may be rechargeable, wherein the at least one battery 58 provides power to the motor 42. In addition, the first handle portion 18 may include the three-positional switch 60 (introduced briefly above) that is electronically associated with the motor 42. The three-position switch 60 may direct the motor 42 to idle, rotate the rollers 32*a-b* in a clockwise direction, and rotate the rollers 32*a-b* in a counter-clockwise direction. Also, the second handle portion 22 may include a bar structure 62 that allows a user to more easily grip the handle portions 18 and 22. The bar 62 may be employed when the handle portions 18 and 22 must be pulled relatively far apart to accommodate a large diameter bolt between the gripping portions 20 and 24.

With the components of the tool 10 having been introduced above, a description of tool 10 usage will follow. A user may use the tool 10 to screw or unscrew the rotatable element 40 (such as a nut or bolt) onto or off of a threaded instrument (such as the screw 41). The user will determine whether the threaded element 40 will be screwed or unscrewed by the tool 10 via activation of the three-position switch 60, wherein activation of the three-position switch 60 signals (via electric association 44*b*) the motor as to which direction the actuatable rollers 32*a-b* should be rotated upon actuation. In order to actuate rotation of the element 40 in either direction, the user must configure the gripping portions 20 and 24 of the tool 10 into a closed gripping position around the element 40 by squeezing together the handle portions 18 and 22. It should be appreciated that the closed gripping position may be any positions of the gripping portions 20 and 24 that allows contact between the gripping portions 20 and 24, or contact between the gripping portions 20 and 24 via the element 40. The handle portions 18 and 22 may be squeezed together via a squeezing of the handles 18 and 22 between the user's palm and fingers, or, for larger diameter elements 40, via a squeezing of the first handle position 18 and the bar structure 62 between the user's palm and fingers respectively.

Configuring the gripping portions 20 and 24 of the tool 10 into the closed gripping position around the element 40 places the rubber belt 36 and at least one trigger roller 50-52 into contact with the element 40. This contact depresses the at least one trigger roller 50-52 (with a sufficient amount of squeezing force applied by the user), which signals (via electric association 44*a*) the motor 42 to actuate (rotate) the actuatable rollers 32*a-b* in the direction signaled by activation of the three-position switch 60. In addition, the at least one trigger roller 50-52 holds the element 40 in contact with the rubber belt 36, which is depressed by the element 40 to deform into the region 38 between the actuatable rollers 32*a-b*. This deformation allows the belt 36 to essentially grip the rotatable element 40, rotating the element 40 in the opposite direction of the rollers 32*a-b*, as the belt 36 moves in the same direction as the rollers 32*a-b*. As the element 40 rotates, the element's rotation causes the at least one trigger roller 50-52 it is contacting to rotate in the opposite direction as the element 40 (or same direction as the actuatable rollers 32*a-b*). When the user ceases to apply sufficient squeeze pressure to depress the at least one trigger roller 50-52 via contact with the element, deformation of the belt 36 and rotation of the rollers 36*a-b* and element 40 also cease.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. An open-ended spin tool comprising:

a first z-shaped structure including a first handle portion swivelably associated with a first gripping portion;

a second z-shaped structure including a second handle portion swivelably associated with a second gripping portion, said second z-shaped structure being pivotably associated with said first z-shaped structure;

a first gripping portion cavity defined by said first gripping portion;

a first actuatable roller and a second actuatable roller at least partially disposed in said first gripping portion cavity, each of said first actuatable roller and said second actuatable roller being rotatably associated with said first gripping portion at an axis of each of said first actuatable roller and said second actuatable roller;

a rubber belt disposed parametrically around said first actuatable roller and said second actuatable roller, said rubber belt being moveable in a direction of rotation of said first actuatable roller and said second actuatable roller, wherein said rubber belt is deformable between said first actuatable roller and said second actuatable roller to at least partially conform to a rotatable element;

a motor to actuate rotation of said first actuatable roller and said second actuatable roller, said motor being disposable in said first gripping portion cavity;

at least one trigger roller at least partially disposed in a second gripping portion cavity defined by said second gripping portion, said at least one trigger roller being depressible within said second gripping portion cavity upon contact of said rotatable element by said rubber belt and said at least one trigger roller; and an electric association between said at least one trigger roller and said motor, wherein depression of said at least one trigger roller triggers said motor to actuate rotation of said first actuatable roller and said second actuatable roller, said depression of said at least one trigger roller being signaled to said motor via said electric association.

2. A tool according to claim 1, wherein at least one of said first handle portion and said second handle portion defines a battery cavity, said battery cavity configured to house at least one battery, wherein said at least one battery provides power to said motor.

3. A tool according to claim 1, further including a three-positional switch disposed on said first handle portion and electronically associated with said motor, said three-position switch directing said motor to idle, rotate said first actuatable roller and said second actuatable roller in a clockwise direction, and rotate said first actuatable roller and said second actuatable roller in a counterclockwise direction.

4. A tool according to claim 1, including a bar structure extending from said second handle portion between said first handle portion and said second handle portion.

* * * * *